US009545710B2

(12) United States Patent
Boice

(10) Patent No.: US 9,545,710 B2
(45) Date of Patent: Jan. 17, 2017

(54) IMPACT TOOL

(71) Applicant: Mark Boice, Santa Ana, CA (US)

(72) Inventor: Mark Boice, Santa Ana, CA (US)

( * ) Notice: Subject to any disclaimer, the term of this patent is extended or adjusted under 35 U.S.C. 154(b) by 721 days.

(21) Appl. No.: 13/836,756

(22) Filed: Mar. 15, 2013

(65) Prior Publication Data

US 2013/0306339 A1 Nov. 21, 2013

Related U.S. Application Data

(60) Provisional application No. 61/688,633, filed on May 18, 2012.

(51) Int. Cl.
*B25D 5/02* (2006.01)
*B25B 19/00* (2006.01)

(52) U.S. Cl.
CPC ..... *B25D 5/02* (2013.01); *B25D 2250/371* (2013.01)

(58) Field of Classification Search
CPC ..... B25D 5/02
USPC ..... 173/1, 83; 383/1, 83
See application file for complete search history.

(56) References Cited

U.S. PATENT DOCUMENTS 889,409 A 6/1908 Spalding
1,225,191 A * 5/1917 Throckmorton ..... B25D 5/02 33/674
2,384,707 A * 9/1945 Sweet ..... B25D 5/02 101/3.1
2,455,270 A * 11/1948 Valentine ..... B25D 5/02 101/3.1
2,587,944 A * 3/1952 Williams ..... B25D 11/00 173/115
2,787,178 A * 4/1957 George ..... B25D 5/02 173/203
2,941,429 A * 6/1960 Mason ..... B21D 1/06 173/91
3,172,204 A * 3/1965 Frey ..... B25D 5/02 30/367
3,933,210 A * 1/1976 Skidmore ..... E21B 4/06 173/132
4,016,640 A * 4/1977 Briggs ..... B23P 11/022 29/235
4,268,927 A * 5/1981 Bridwell ..... B25D 5/00 30/367
4,470,440 A * 9/1984 Thor ..... B27L 7/005 144/195.5
4,488,759 A * 12/1984 Bergqvist ..... E21C 35/187 299/110
4,681,171 A * 7/1987 Kee ..... B25D 1/00 173/90
4,682,412 A * 7/1987 Pfeffer ..... B25D 5/00 173/205

(Continued)

*Primary Examiner* — Andrew M Tecco
*Assistant Examiner* — Praachi M Pathak
(74) *Attorney, Agent, or Firm* — Stetina Brunda Garred & Brucker

(57) ABSTRACT

An impact tool which provides a consistent level of impact force is provided. The internal mechanism of the impact tool has a trip release member and a hammer which remains in constant contact over a constant surface area throughout cycling of the impact tool. Additionally, the trip release member may slide against a slug having a straight conical surface to minimize variation. Moreover, the hammer may be non-rotateable so that a non round or asymmetrical head may be used.

13 Claims, 8 Drawing Sheets

(56) References Cited

U.S. PATENT DOCUMENTS

| | | | | | |
|---|---|---|---|---|---|
| 4,721,903 | A * | 1/1988 | Harsch | G01R 1/06788 | 30/367 |
| 4,733,812 | A * | 3/1988 | Lewis | B25C 1/02 | 227/147 |
| 4,850,437 | A * | 7/1989 | Sudnishnikov | B21J 15/18 | 173/13 |
| 5,321,999 | A * | 6/1994 | Lin | B25D 5/02 | 173/121 |
| 5,662,686 | A | 9/1997 | Newsum | | |
| 5,730,021 | A * | 3/1998 | Johnson | B25D 17/02 | 173/132 |
| 5,921,456 | A * | 7/1999 | Kirsch | A61B 17/068 | 173/124 |
| 6,257,093 | B1 * | 7/2001 | Bergacker | A62B 3/005 | 7/165 |
| 6,902,093 | B1 * | 6/2005 | Chang | B25C 1/02 | 173/124 |
| 8,517,340 | B2 * | 8/2013 | Pell | B25D 17/02 | 227/63 |
| 8,844,409 | B2 * | 9/2014 | Lin | B25B 23/0035 | 173/90 |
| 9,206,577 | B2 * | 12/2015 | Lusk | E02D 7/04 | |
| 2002/0112599 | A1 * | 8/2002 | Sabates | A22B 3/02 | 89/1.14 |
| 2003/0047887 | A1 * | 3/2003 | Hahn | B25D 17/088 | 279/19.1 |
| 2003/0047888 | A1 * | 3/2003 | Hahn | B25D 17/088 | 279/19.1 |
| 2012/0024117 | A1 * | 2/2012 | Kreutzer | B25B 19/00 | 81/463 |

* cited by examiner

IMPACT TOOL

CROSS-REFERENCE TO RELATED APPLICATIONS

This application claims the benefit of provisional patent application Ser. No. 61/688,633, filed on May 18, 2012, the entire contents of which is expressly incorporated herein by reference.

STATEMENT RE: FEDERALLY SPONSORED RESEARCH/DEVELOPMENT

Not Applicable

BACKGROUND

The various embodiments disclosed herein relate to an impact tool for providing a measured impact forced to a surface, and more particularly for providing a new use for a center punch.

Various center punches exist in the prior art. The center punches provide an impact force to a local area on a surface. However, these center punches suffer in that they do not provide a consistent level of impact force at the same setting and also are not durable over an extended period of use.

Accordingly, there is a need in the art for an improved center punch and also for extending the use of center punches.

BRIEF SUMMARY

The various aspects of the impact tool described herein address the needs discussed above, discussed below and those that are known in the art.

The impact tool provides a consistent level of impact force for each application or use. This is accomplished by providing for certain key features within the internal mechanism of the impact tool which may include but is not limited to any one or more of the following features. For example, a slug within the impact tool has a conical distal surface which engages a proximal end of a trip release member. The conical distal surface provides a linear resistance to the trip release member as the trip release member lines up to the center of the slug. The linear resistance provides the consistent repeatable level of impact for each use. Moreover, when the slug is forcibly pushed forward toward the contact surface areas of the trip release member and the hammer, the trip release member contacts the hammer in the same area for each cycle leading to a highly repeatable and consistent level of impact force. The area of contact between the trip release member and the hammer is the same for each repeated use thereby providing a consistent level of impact force for each use. In particular, the distal end of the release member has a spherical configuration which matches a spherical configuration of a proximal end of the hammer. Also, a diameter of the distal end of the trip release member is smaller than the proximal end of the hammer so that the entire surface of the distal end of the trip release member always contacts the hammer when the slug pushes forward to create the impact force. The impact tool also provides for use of an asymmetrical head by locking rotation of the hammer so that the asymmetrical head which applies the impact force to the surface does not rotate before and after impact. Moreover, the trip release member is biased to a tilted configuration by a conical compression spring that is skewed about its length.

More particularly, an impact tool for providing a measured impact force to a surface is disclosed. The tool may comprise a first spring, a body, a cover, a slug, a second spring, a trip release member, a hammer, and a nose. The first spring stores energy which when released provides the measured impact force to the surface. The body may have a narrow neck at an internal middle position. A first cavity may be disposed on one side of the narrow neck for receiving the first spring therein. A second cavity may be disposed on an opposed side of the narrow neck. The cover may be threadably securable to the body for presetting an initial preload of the first spring to increase or decrease the measured impact force to the surface. The slug may be slidably disposed within the first cavity with the first spring disposed between the slug and the cover. The distal end of the slug may have a conical surface which has an angle 25 (see FIG. 2) about 15 degrees to about 25 degrees, and is preferably, about 20 degrees from a transverse plane to a central axis of the slug. The second spring may be disposed within the second cavity. The second spring may be skewed from a longitudinal axis about 30 degrees to about 45 degrees from the longitudinal axis of the second spring. The trip release member may have the second spring disposed therearound. The skewed second spring may bias the proximal end of the trip release member to a side of the narrow neck of the body. A distal end of the trip release member may have a convex surface. The hammer may be slideable with respect to the body. A proximal end of the hammer may have a concave surface configured to mate with the convex surface of the trip release member. The concave surface may be larger than the convex surface. The convex surface and the concave surface may be defined by a radius R so that the entire convex surface remains in contact with the concave surface when measured impact to the surface is transferred to the hammer and as the trip release member is being aligned to a receiving hole in the slug. The nose may be engaged to a distal end of the body with the second spring disposed between the narrow neck of the body and the nose. The hammer may be slidably disposed within a distal aperture of the nose. The distal aperture may have a non-circular shape and an external configuration of the hammer matching the non-circular shape of the distal aperture to prevent rotary movement of the hammer about its longitudinal central axis.

In another aspect, an impact tool for providing a measured impact to a surface is disclosed. The tool may comprise a first spring, a body, a cover, a slug, a second spring, a trip release member and a hammer. The first spring may provide the measured impact to the surface. The body may have a narrow neck at an internal middle position. A first cavity may be disposed on one side of the narrow neck for receiving the first spring therein. A second cavity may be disposed on an opposed side of the narrow neck. The cover may be threadably securable to the body for presetting an initial preload of the first spring to increase or decrease the measured impact to the surface. The slug may be slidably disposed within the first cavity with the first spring disposed between the slug and the cover. The second spring may be disposed within the second cavity. The second spring may have a skewed longitudinal axis. The trip release member may have the second spring disposed therearound. The skewed second spring biases the proximal end of the trip release member to a side of the narrow neck of the body. A distal end of the trip release member may have a convex surface. The hammer is slideable within the body. A proximal end of the hammer may have a concave surface configured to mate with the convex surface of the trip release member. The concave surface may be larger than the convex surface.

A distal end of the slug may have a conical surface.

The convex surface and the concave surface may be defined by a radius R so that the entire convex surface remains in contact with the concave surface when energy is delivered to the surface from the hammer.

The conical surface of the distal end of the slug may be about 20 degrees from a transverse plane to a central axis of the slug.

The second spring may be skewed about 30 degrees to about 45 degrees from a central axis of the second spring.

The tool may further include a nose engaged to a distal end of the body with the second spring disposed between the narrow neck of the body and the nose. The hammer may be slidably disposed within a distal aperture of the nose. The distal aperture may have a circular shape. Also, the hammer may have an external configuration matching the circular shape of the distal aperture to promote rotary movement of the hammer about its longitudinal central axis. It is also contemplated that the distal aperture of the nose and the external configuration of the hammer may have a non circular shape to prevent rotation of the hammer. For example, the non circular configuration may be a hexagonal configuration.

In another aspect, a method of operation of a tool for providing a measured impact to a surface is disclosed. The method may comprise the steps of pushing a body of the tool toward the surface; compressing an impact spring during the pushing step; sliding a proximal end of a trip release member on a conical surface at a distal end of a slug toward a center of the conical surface; raming the slug on a proximal end of the trip release member; and transferring an impact force created by the raming step from an impact spring through the slug and the trip release member to a hammer.

The transferring step may include the step of contacting an entire convex surface of the trip release member to a concave surface of the hammer.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
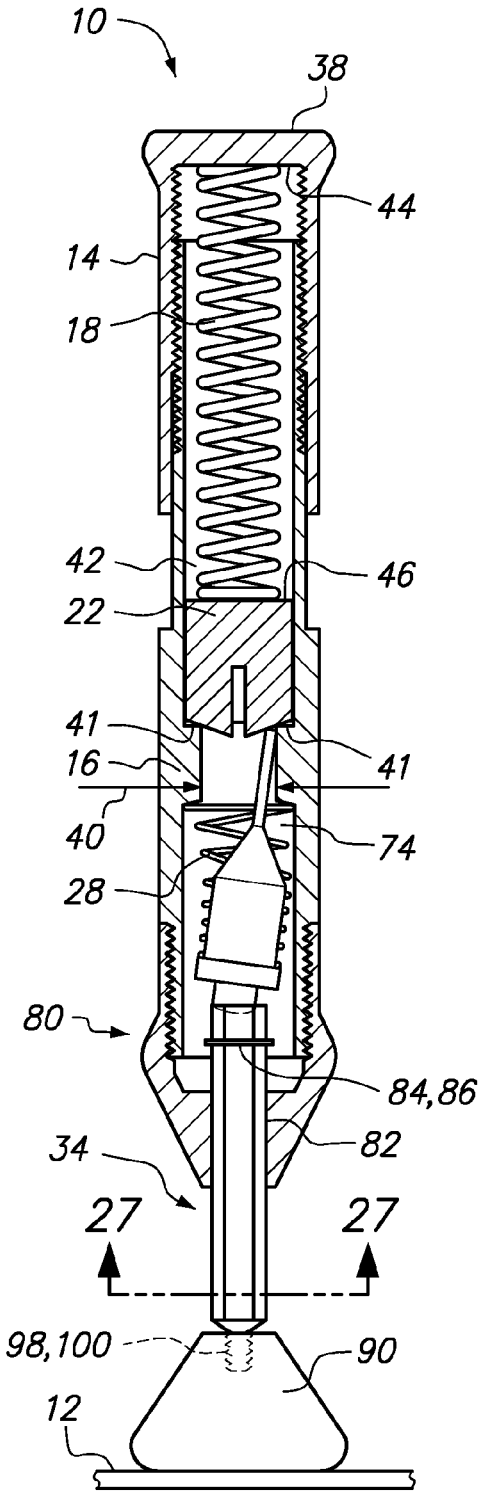
FIG. 1A is a cross-sectional view of an impact tool in a first position.

Referring now to the drawings, an impact tool 10 is shown which can provide a variable measured impact force to a surface 12 by adjusting a cover 14 up or down on a body 16 of the impact tool 10. The cover 14 when adjusted down on the body 16 increases a preload of a spring 18 while adjusting the cover 14 upward on the body 16 decreases the preload of the spring 18. The user pushes the impact tool 10 on the surface 12 further compressing the spring until a trip release member 20 is aligned to a central aperture 19 of a slug 22 (see FIG. 1C). When the trip release member is aligned to the central aperture 19, the slug 22 is forcibly pushed into the trip release member 20 (see FIG. 1D) to create the measured impact force. In order to provide a consistent measured impact force, a distal end of the slug 22 has a conical surface 24 to help smoothly guide a proximal end 26 of the trip release member 20 on the conical surface 24 into the central aperture 19 of the trip release member 20. Additionally, a second spring 28 is skewed (see FIG. 4) to bias the trip release member 20 to the side. Moreover, a distal end surface 30 (see FIG. 4) of the trip release member 20 has a convex configuration which is matched to and smaller than a concave configuration of a proximal end surface 32 of a hammer 34 to provide a consistent transfer of energy from the trip release member 20 to the hammer 34.

The hammer 34 may also be designed to not rotate so that a head 36 of the impact tool 10 having a non-round shape may be secured to the hammer 34 and provide a unique measured impact force to the surface 12 which cannot be achieved with a round head 36. The impact tool 10 discussed herein provides a consistent measured impact force to the surface 12 on a consistent basis.

More particularly, referring now to FIG. 1A, the cover 14 is threadably engageable to the body 16. To this end, the cover 14 may have internal threads that engage external threads of the body 16 which are formed at the proximal side of the body 16. By threading the cover 14 further into the body 16, the user can apply a greater preload on the first spring 18 which in turn will apply a greater measured impact force to the surface 12. Conversely, by threading the cover 14 further off of the body 16, the user can apply a lower preload on the first spring 18 which in turn will apply a lower measured impact force to the surface 12. The upper surface 38 of the cover 14 may have a curved configuration. The upper surface 38 of the cover 14 has a bulbous configuration so that the user's hand is protected if the user chooses to push down on the upper surface 38 of the impact tool 10 with his or her hand to actuate the impact tool 10. The enlarged surface area of the upper surface 38 distributes the forces over a wider area on the users hand to provide comfort while pushing down on the device on the cover 14, if needed.

The body 16 has a narrow neck 40 which defines an interior cavity 42 which receives the first spring 18. This first spring 18 is disposed within the interior cavity 42 between the cover 14 and the slug ledge 41 which helps to define the narrow neck 40 of the body 16. The interior cavity 42 also receives the slug 22. The slug 22 is slidably receivable in the interior cavity 42 of the body 16. The first spring 18 may be a coil compression spring with flat opposed ends which are seated on a bottom surface 44 of the cover 14 and a proximal flat surface 46 of the slug 22. By threading the cover 14 further into or further off of the body 16, the preload on the first spring 18 is increased or decreased to increase or decrease the measured impact force applied to the surface 12. The distal surface 24 of slug 22 may have a conical configuration as well as a receiving hole 19 that receives a proximal end portion 15 of the trip release member 20. As the user pushes the tool 10 into the surface 12, the proximal end 26 of the trip release member 20 slides on the conical surface 24 of the slug 22 until the proximal end 26 reaches the receiving hole 19 of the slug 22. This progression is shown in FIGS. 1A-1D. Since the distal end surface 24 of the trip release member 20 is conical and not curved, the proximal end 26 of the trip release member 20 gradually slides against the distal end surface 24 of the slug 22. For each unit of travel of the proximal end 26 of the trip release member 20 against the conical surface 24 of the slug 22, the user must increase the amount of push down force on the tool 10 a corresponding unit amount. The proximal end 26 of the trip release member 20 does not get snagged or caught up on the conical surface 24 of the slug 22. This configuration helps to provide a consistent measured impact force to the surface 12.

Figure 1B:
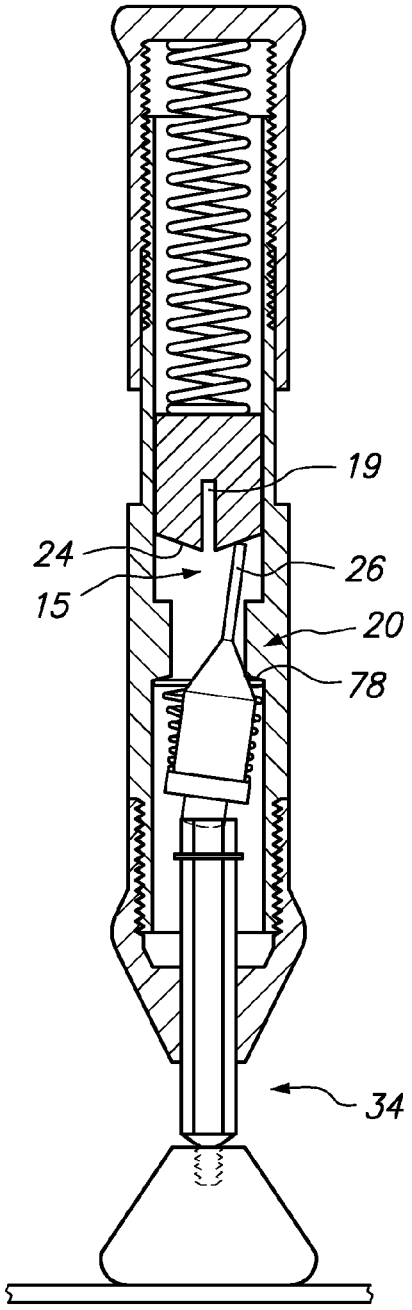
FIG. 1B is a cross-sectional view of the impact tool shown in FIG. 1 in a second position.
Figure 1C:
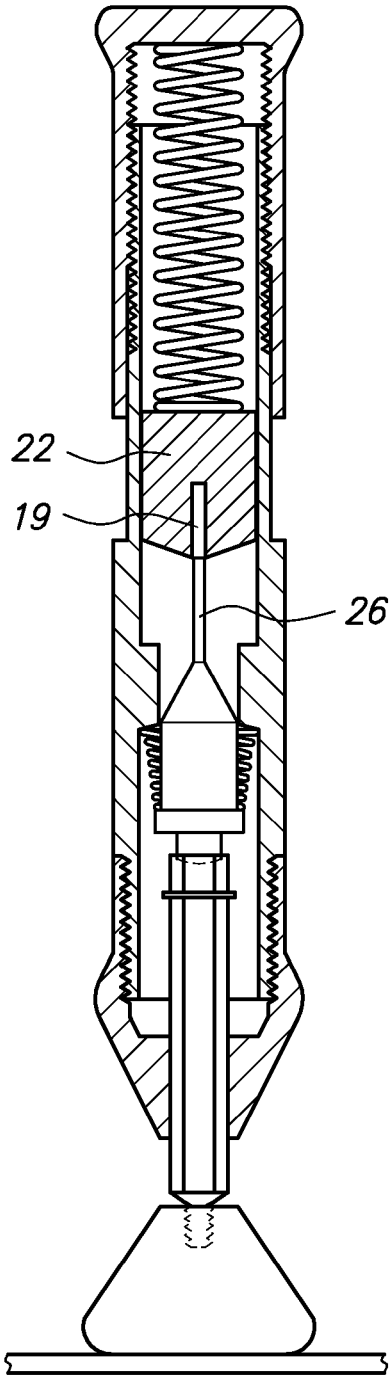
FIG. 1C is a cross-sectional view of the impact tool shown in FIG. 1 in a third position.
Figure 1D:
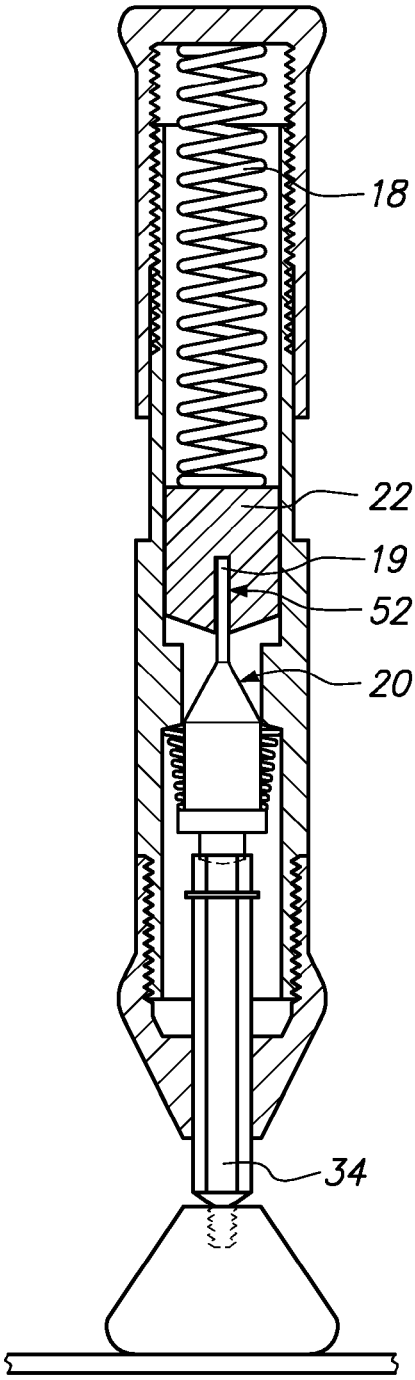
FIG. 1D is a cross-sectional view of the impact tool shown in FIG. 1 in a fourth position.
Figure 2:
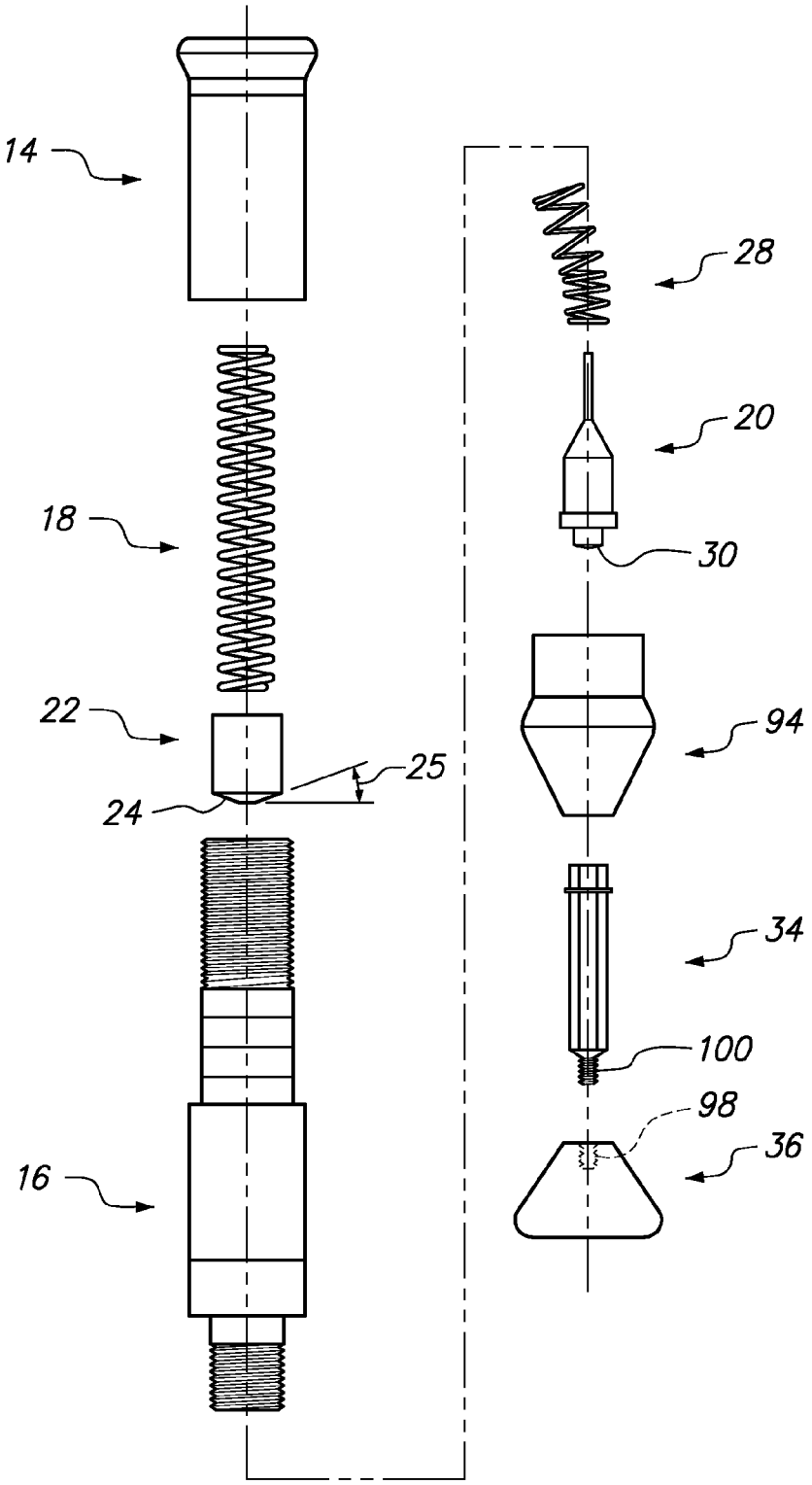
FIG. 2 is an exploded view of the impact tool shown in FIG. 1.
Figure 3:
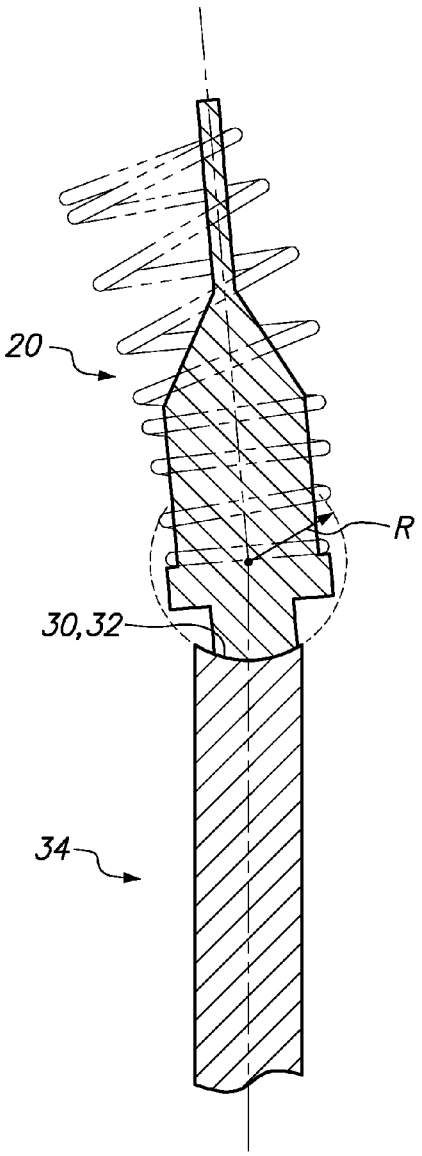
FIG. 3 is a view of a trip release member and a hammer illustrating that an entire contact surface of the trip release member remains in contact with a contact surface of the hammer.
Figure 4:
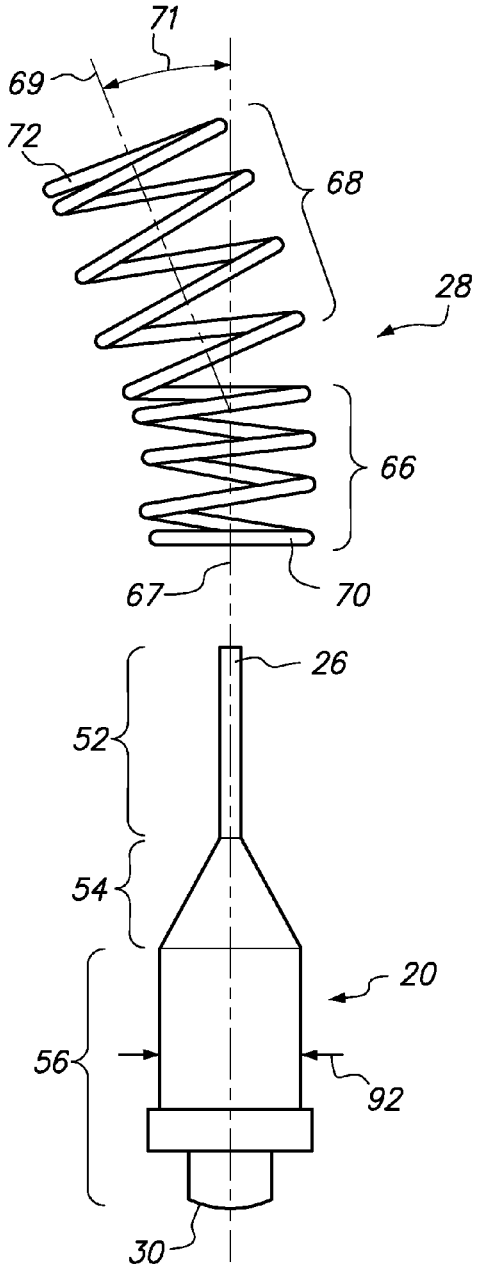
FIG. 4 illustrates a spring and the trip release member.
Figure 5:
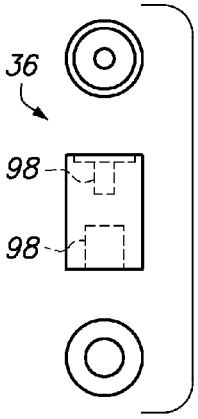
FIG. 5 illustrates a first embodiment of a head removably attachable to the hammer.
Figure 6:
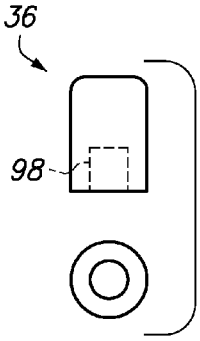
FIG. 6 illustrates a second embodiment of the head removably attachable to the hammer.
Figure 7:
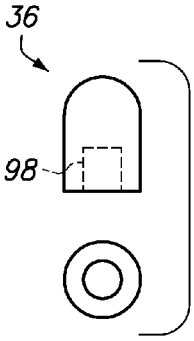
FIG. 7 illustrates a third embodiment of the head removably attachable to the hammer.
Figure 8:
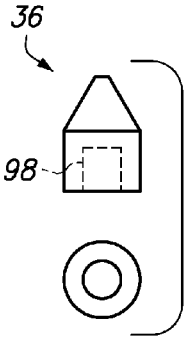
FIG. 8 illustrates a fourth embodiment of the head removably attachable to the hammer.

The trip release member 20 has a straight section 52, a tapered section 54, a seat section 56 and a hammer interface surface 30, as shown in FIG. 4. The straight section 52 is received into the receiving hole 19 of the slug 22, as shown in FIG. 1D. When the straight section 52 of the trip release member 20 is aligned to the receiving hole 19 (see FIG. 1C), the first spring 18 rapidly and forcibly pushes the slug 22 against the straight section 52 of the trip release member 20 (see FIG. 1D). Upon contact between the slug 22 and the trip release member 20, the energy stored within the first spring 18 is released and transferred into the slug 22 and the trip release member 20. Next, the energy is also transferred from the trip release member 20 into the hammer 34. To efficiently transfer the energy from the trip release member 20 into the hammer 34, the distal end surface 30 of the trip release member 20 has the identical configuration compared to a proximal surface 32 of the hammer 34, as shown in FIG. 3. More particularly, the distal end surface 30 of the trip release member 20 has a spherical configuration defined by a radius R. Likewise, the proximal end surface 32 of the hammer 34 has a spherical configuration defined by the radius R. The sphere defining the distal end surface 30 of the trip release member 20 and the proximal end surface 32 of the hammer 34 are identical to each other so that as the proximal end 26 of the trip release member 20 slides against the conical surface 24 of the slug 22, the entire area of the distal end surface 30 of the trip release member 20 always maintains contact with the proximal surface 32 of the hammer 34. In the example shown in the figures, the distal end surface 30 of the trip release member 20 has a convex configuration, whereas, the proximal surface 32 of the hammer 34 has a concave configuration. However, it is also contemplated that the distal end surface 30 of the trip release member 20 may have a concave configuration whereas, the proximal surface 32 of the hammer 34 may have a convex configuration.

In the initial state, the straight section 52 is disposed within the neck 40 of the body 16, as shown in FIG. 1A. The first spring 18 pushes the slug 22 against a slug stop ledge 41. The proximal end 26 of the trip release member 20 is tilted to the side so that the proximal end 26 of the trip release member 20 is not aligned and cannot be received into the receiving hole 19 of the slug 22 in the at rest position. The proximal end 26 of the trip release member 20 rests on the conical surface 24 of the slug 22. This is accomplished with a second spring 28 that is skewed, as shown in FIG. 4. The second spring 28 is mounted to the trip release member 20 as shown in FIG. 3. The second spring 28 may be a tapered coiled compression spring. This tapered coil compression spring may define a longitudinal axis. A bend may be formed in the middle of the second spring 28 in an abrupt fashion so that a first portion 66 of the second spring 28 defines a longitudinal axis 67 which is skewed 71 about 30° to about 45° from a longitudinal axis 69 defined by a second portion 68 of the second spring 28, as shown in FIG. 4. The second spring 28 has a smaller end 70 and a larger end 72. The smaller end 70 of the second spring 28 is seated onto the seat section 56 of the trip release member 20. The smaller end 70 is wrapped tightly around the seat section 56. Due to the bend in the second spring 28, the proximal end 26 of the trip release member 20 resides adjacent a side of the larger end 72 of the second spring 28.

Referring now to FIG. 1A, the body 16 has an interior cavity 74 which receives the trip release member 20 and the second spring 28. The interior cavity 74 has an inner diameter which is matched closely to an outer diameter of the larger end 72 of the second spring 28. As such, when the second spring 28 is inserted into the interior cavity 74, the spring 28 urges the proximal end 26 of the trip release member 20 to the side. When the user pushes the impact tool 10 toward the surface 12, the proximal end 26 of the trip release member 20 is pushed against the conical surface 24 of the slug 22 and is not received into the receiving hole 19 of the slug 22 until the desired measured impact force is reached in the first spring 18. The seat section 56 has a flange 76 which holds the second spring 28 in place.

In order to slide the proximal end 26 of the trip release member 20 to the receiving hole 19 of the slug 22, the trip release member 20 has a tapered section 54. As the user pushes the impact tool 10 against the surface 12, the trip release member 20 proceeds further into the narrow neck 40 until the tapered section 54 contacts a lower edge 78 of the narrow neck 40, as shown in FIG. 1B. As the trip release member 20 proceeds further into the narrow neck 40, the lower ledge 78 of the narrow neck 40 begins to push the tapered section 54 to the middle which in turn pushes the proximal end 26 of the trip release member 20 to the center and into the receiving hole 19. An outer diameter 92 of the seat section 56 of the trip release member 20 is slightly smaller than an inner diameter of the narrow neck 40 so that the proximal end 26 of the trip release member 20 aligns to the receiving hole 19 when the seat section 56 enters the narrow neck 40 as shown in FIG. 1C.

Figure 27:
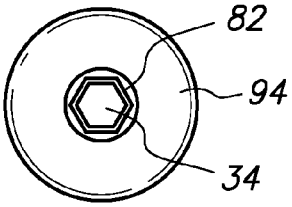
FIG. 27 illustrates a distal end view of the nose shown in FIG. 1A.

A nose 80 may be threaded onto the body 16. The nose 80 may have a thumb bump 94 to assist the user in pushing the impact tool 10 into the surface 12. The nose 80 has a through hole 82 in which the hammer 34 is allowed to slide back and forth. A retaining ring 84 is disposed within a groove 86 formed in the hammer 34. The retaining ring 84 prevents the hammer 34 from falling out and retains the hammer 34 in the nose 80. The through hole 82 may be circular to allow the hammer 34 force to rotate about its longitudinal axis 88. Preferably, the hammer 34 has a corresponding cylindrical configuration (i.e., round) and is sized and configured to snugly fit within the through hole 82. The hammer 34 is allowed to slide back and forth in the through hole 82. Alternatively, the through hole 82 may have a non-circular configuration. By way of example and not limitation, as shown in FIG. 27, the through hole 82 may have a hexagonal configuration. Likewise, the hammer 34 may also have a hexagonal configuration and may be sized and configured to be snugly received into the hexagonal through hole 82. In this manner, the hammer 34 cannot rotate and is in a fixed position. When a head 90 is mounted to the distal end of the hammer 34, the head 90 does not rotate. As such, an irregular shaped head 90 may be attached to the hammer 34 and utilized to apply a measured impact forced to the surface in a unique manner that a round or symmetrical head 90 cannot achieve.

Referring now to FIGS. 5-10 and 12-26, a variety of accessory heads 36 are shown. These heads 36 may have a threaded hole 98 which is threadably engageable to threads 100 on the distal end of the hammer 34. Any one of the heads 36 is interchangeably attachable to the distal end of the hammer 34. The accessory heads 36 include examples of asymmetrical shaped tool heads 36 that make contact with the surface 12. The asymmetry is with respect to a longitudinal axis that runs through the tool 10. Since the tool 10 may be utilized to remove dents from a metallic surface and these dents may be asymmetrical, it is critical that a portion of the accessory head 36 themselves be asymmetrical. When utilizing asymmetrical heads 36, it is important that the asymmetrical head 36 maintains its position and does not rotate before or after impact to the surface 12. To this end, one of the heads 36 is screwed on tight onto the threaded portion 100 of the hammer 34. Also, the asymmetrical heads 36 are preferably attached to the hammer 34 which does not rotate. The hammer 34 has a hex configuration that mates with a hex configuration throughhole 82 of the nose 80. The threaded holes 98 are shown in the figures but may be located anywhere on the head 36 in order to provide a custom impact force to a surface 12, as needed.

Figure 9:
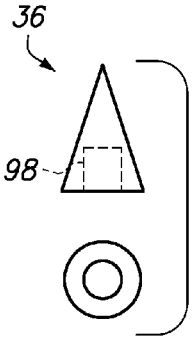
FIG. 9 illustrates a fifth embodiment of the head removably attachable to the hammer.
Figure 10:
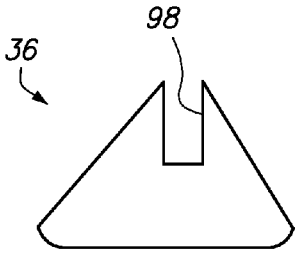
FIG. 10 illustrates a sixth embodiment of the head removably attachable to the hammer.

FIG. 9 illustrates a conical tool head 36. This conical tool head 36 is symmetrical about the longitudinal axis. Preferably, the conical tool head 36 has an angle of 45° but may be formed at other angles as well.

Moreover, it is contemplated that the head 36 may be shapable by the user. As discussed herein, a dent may require a head 36 having a special and unique shape. In this instance, the user may grind and shape his or her own head for attachment to the hammer 34.

The impact tool 10 discussed herein may be utilized in a variety of circumstances. By way of example and not limitation, the impact tool 10 may be utilized to remove a dent from a piece of sheet metal (e.g., car door, plate, etc.). In relation to car doors, the car door may have a small ding or dent. To remove the dent, the door is disassembled until a repair person can access the dent from the side where the dent protrudes upward. The repair person will start with a low setting first on the impact tool 10. This means that the cover 14 is threaded off of the body 16 to minimize the preload on the first spring 18 and the resultant impact force on the door or surface 12. The repair person aligns a head 36 on the dent that protrudes upward and pushes the impact tool into the dent. As the repair person pushes the impact tool 10 into the dent, the spring 18 is being further compressed and storing energy. The proximal end 26 of the trip release member 20 slides on the conical surface 24 of the slug 22 until the proximal end 26 of the trip release member is aligned to the receiving hole 19 of the slug 22. At this time the stored energy in the spring 18 is released. The spring 18 pushes the slug forward into the trip release member. The force is transferred between the trip release member 20 and the hammer 34 through the distal end surface 30 of the trip release member 20 and the proximal end surface 32 of the hammer 34. Since the entire area of the distal end surface 30 of the trip release member 20 always contacts the proximal end surface 32 of the hammer 34, the energy is efficiently transferred into the hammer 34 thereby proving a consistent level of impact force each time. The hammer 34 transfers the energy into the head 36 and into the surface. If the dent is not removed, the repair person may thread the cover 14 further into the body 16 to increase the preload on the spring 18 and the impact force to the surface 12. This process is repeated until the dent is removed.

The dent may have a non uniform shape. In this instance, a round head 36 may not be able to properly remove the dent. A non round or non symmetrical head 36 must be used. To use the non round or non symmetrical head 36, the hammer 34 and nose 80 with the non round configuration is used so that the hammer 34 does not rotate, and thus, the non round or non symmetrical head 36 does not rotate as well.

The impact tool 10 may be used in other situations as well such as hammering a nail. A head of nail in certain circumstances need to be made perfectly flush with a surface. To do so, a person may use a hammer to start nailing the nail into the surface. To make the nail head flush with the surface, the user can use the impact tool 10 by placing a head 36 with a small tip that is smaller than the nail head onto the nail head. The user adjusts the impact force by threading the cover further into or off of the body 16, as discussed above. The user drive the nail into the surface by repeatedly using the impact tool 10 until the nail head is perfectly flush with the surface.

Figure 11:
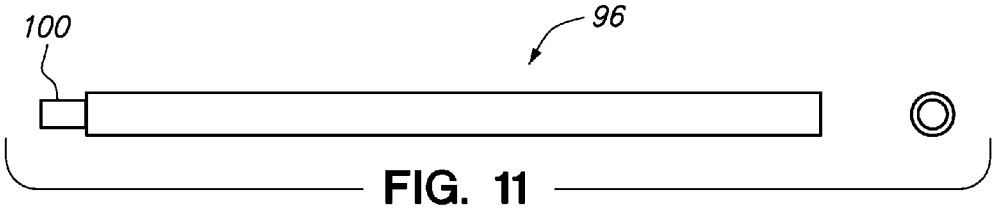
FIG. 11 illustrates an extension for positioning the head further away from the nose of the impact tool.
Figure 12:
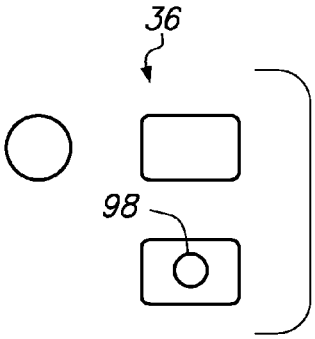
FIG. 12 illustrates a seventh embodiment of the head removably attachable to the hammer.
Figure 13:
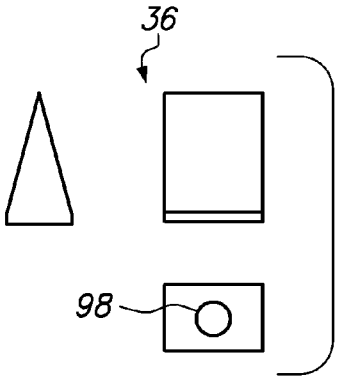
FIG. 13 illustrates an eighth embodiment of the head removably attachable to the hammer.
Figure 14:
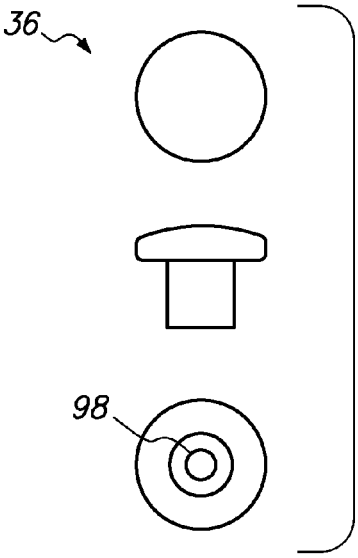
FIG. 14 illustrates a ninth embodiment of the head removably attachable to the hammer.
Figure 15:
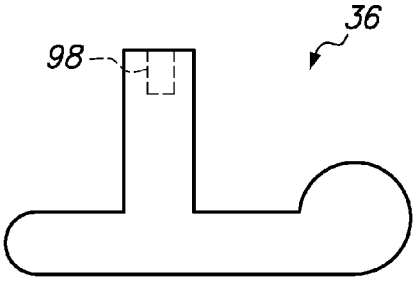
FIG. 15 illustrates a tenth embodiment of the head removably attachable to the hammer.
Figure 16:
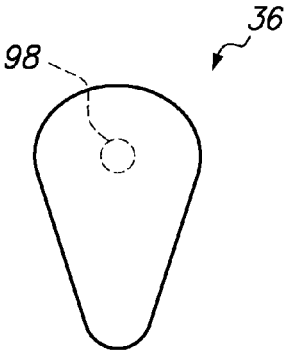
FIG. 16 illustrates an eleventh embodiment of the head removably attachable to the hammer.
Figure 17:
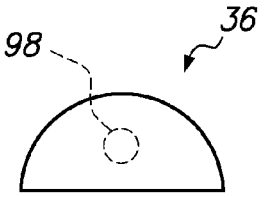
FIG. 17 illustrates a twelfth embodiment of the head removably attachable to the hammer.
Figure 18:
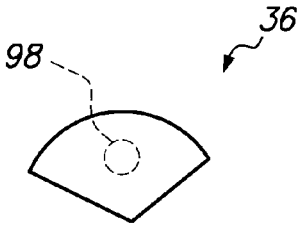
FIG. 18 illustrates a thirteenth embodiment of the head removably attachable to the hammer.
Figure 19:
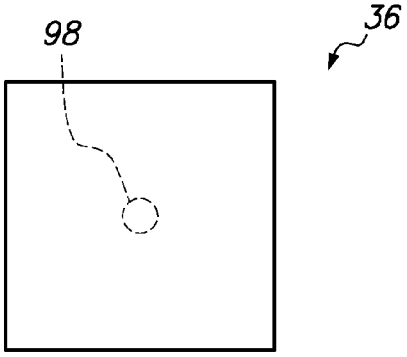
FIG. 19 illustrates a fourteenth embodiment of the head removably attachable to the hammer.
Figure 20:
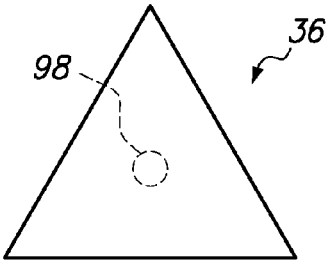
FIG. 20 illustrates a fifteenth embodiment of the head removably attachable to the hammer.
Figure 21:
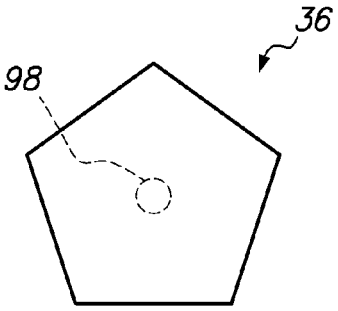
FIG. 21 illustrates a sixteenth embodiment of the head removably attachable to the hammer.
Figure 22:
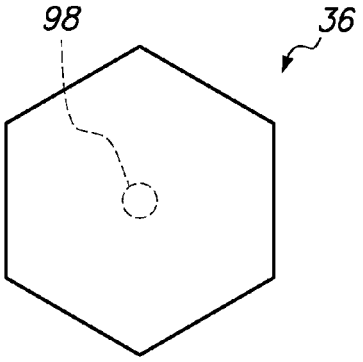
FIG. 22 illustrates a seventeenth embodiment of the head removably attachable to the hammer.
Figure 23:
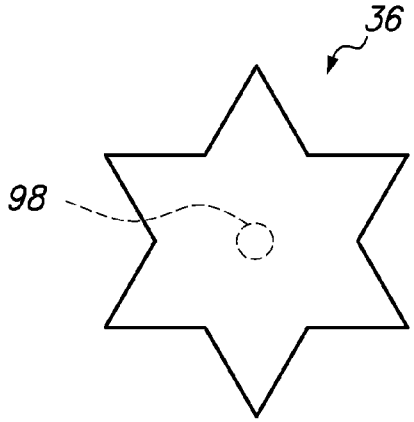
FIG. 23 illustrates an eighteenth embodiment of the head removably attachable to the hammer.
Figure 24:
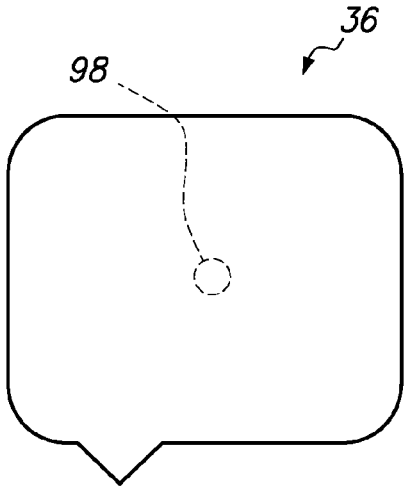
FIG. 24 illustrates a nineteenth embodiment of the head removably attachable to the hammer.
Figure 25:
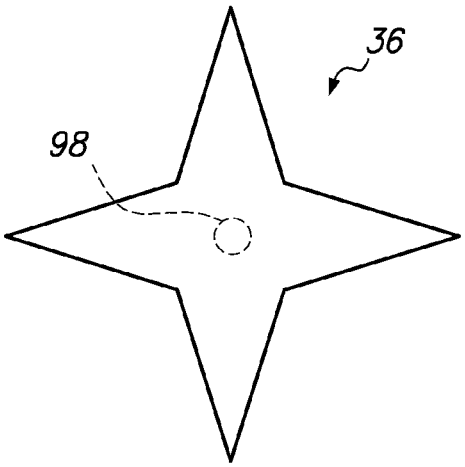
FIG. 25 illustrates a twentieth embodiment of the head removably attachable to the hammer.
Figure 26:
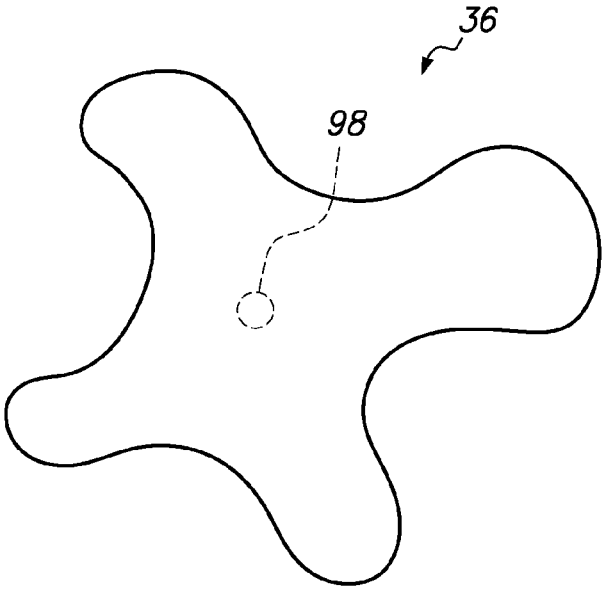
FIG. 26 illustrates a twenty-first embodiment of the head removably attachable to the hammer.

Referring now to FIG. 11, the impact tool 10 may be utilized with an extension 96. The extension is threaded onto the end of the hammer 34 in the same manner that the head 36 is threaded onto the end of the hammer 34. After threading the extension 96 onto the hammer 34, the head 36 is threaded onto the distal end of the extension 96. This allows the head 36 to reach hard to reach areas.

The various aspects of the impact tool 10 disclosed herein have been described in relation to the removal of a dent from a sheet metal. However, the impact tool 10 may be utilized in relation to other scenarios such as removing a roll pin from a hole or driving a nail into a surface. The impact tool 10 may be utilized to provide a measured impact force to the head of the nail so that the upper surface of the nail head is flush with the surface.

The above description is given by way of example, and not limitation. Given the above disclosure, one skilled in the art could devise variations that are within the scope and spirit of the invention disclosed herein, including various ways of forming the head 36. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An impact tool for providing a measured impact force to a surface, the tool comprising:

a first spring for providing the measured impact to the surface;

a body having a narrow neck at an internal medial position, a first cavity on one side of the narrow neck for receiving the first spring therein, a second cavity on an opposed side of the narrow neck;

a cover threadably securable to the body for presetting an initial preload of the first spring to increase or decrease the measured impact to the surface;

a slug slidably disposed within the first cavity with the first spring disposed between the slug and the cover, a distal end of the slug having a conical surface which is about 20 degrees from a transverse plane to a central axis of the slug;

a second spring disposed within the second cavity, the second spring being skewed from a longitudinal axis about 30 degrees to about 45 degrees from the longitudinal axis of the second spring;

a trip release member with the second spring disposed around the trip release member wherein the skewed second spring biases the proximal end of the trip release member to a side of the narrow neck of the body, a distal end of the trip release member having a convex surface;

a hammer slideable with respect to the body, a proximal end of the hammer having a concave surface configured to mate with the convex surface of the trip release member, the concave surface being larger than the convex surface, the convex surface and the concave surface being defined by a radius R so that the entire convex surface remains in contact with the concave surface when measured impact to the surface is transferred to the hammer;

a nose engaged to a distal end of the body with the second spring disposed between the narrow neck of the body and the nose, the hammer being slidably disposed within a distal aperture of the nose, the distal aperture having a non-circular shape and an external configuration of the hammer matching the non-circular shape of the distal aperture to prevent rotary movement of the hammer about its longitudinal central axis;

a head attached to the hammer, the head having a non-symmetrical configuration about a longitudinal axis of the head, the longitudinal axis being aligned to a direction of travel of the head when attached to the hammer and the tool is operated.

2. The tool of claim 1 wherein the cover is threadable onto the body or off of the body to adjust the initial preload of the first spring.

3. The tool of claim 1 further comprising a head that is threadably engageable to the hammer, the head being non rotateable when the head is tightened onto the hammer.

4. An impact tool for providing a measured impact to a surface, the tool comprising:

a first spring for providing the measured impact to the surface;

a body having a narrow neck at an internal medial position, a first cavity on one side of the narrow neck for receiving the first spring therein, a second cavity on an opposed side of the narrow neck;

a cover threadably securable to the body for presetting an initial preload of the first spring to increase or decrease the measured impact to the surface;

a slug slidably disposed within the first cavity with the first spring disposed between the slug and the cover;

a second spring disposed within the second cavity, the second spring having a skewed longitudinal axis;

a trip release member with the second spring disposed around the trip release member wherein the skewed second spring biases a proximal end of the trip release member to a side of the narrow neck of the body, a distal end of the trip release member having a convex surface;

a hammer slideable with respect to the body, a proximal end of the hammer having a concave surface configured to mate with the convex surface of the trip release member, the concave surface being larger than the convex surface;

a nose engaged to a distal end of the body with the second spring disposed between the narrow neck of the body and the nose, the hammer being slidably disposed within a distal aperture of the nose, the distal aperture having a non circular configuration and the external configuration of the hammer locks into the non circular configuration of the distal aperture of the nose so that the hammer remains rotationally stationary within the distal aperture of the nose;

a head attached to the hammer, the head having a non-symmetrical configuration about a longitudinal axis of the head, the longitudinal axis being aligned to a direction of travel of the head when attached to the hammer and the tool is operated.

5. The tool of claim 4 wherein a distal end of the slug has a conical surface.

6. The tool of claim 4 wherein the convex surface and the concave surface are defined by a radius R so that the entire convex surface remains in contact with the concave surface when measured impact to the surface is transferred to the hammer.

7. The tool of claim 4 wherein a conical surface of the distal end of the slug is about 15 degrees to about 25 degrees from a transverse plane to a central axis of the slug.

8. The tool of claim 7 wherein the conical surface of the distal end of the slug is about 20 degrees from the transverse plane to the central axis of the slug.

9. The tool of claim 4 wherein the second spring is skewed about 30 degrees to about 45 degrees from a central axis of the second spring.

10. The tool of claim 9 wherein the second spring is skewed to the 30 degree to 45 degree angle.

11. The tool of claim 4 wherein the distal aperture of the nose has a hex configuration and the external configuration of the hammer has a hex configuration.

12. A method of operation of a tool for providing a measured impact to a surface, the method comprising the steps of:

attaching a head which is not symmetrically about a longitudinal axis of the tool to a hammer;

pushing a body of the tool toward the surface;

compressing an impact spring during the pushing step;

sliding a proximal end of a trip release member up on a conical surface formed at a distal end of a slug toward a center of the conical surface;

raming the slug on the distal end of the trip release member; and transferring an impact force created by the raming step from an impact spring through the slug and the trip release member to the hammer;

maintaining an angular orientation of the hammer and the head by forming a non circular aperture through a nose attached to the body and a portion of the hammer that slides through the aperture of the nose having a matching exterior configuration of the non circular aperture of the hammer during the pushing, compressing, sliding raming and transferring steps.

13. The method of claim 12 wherein the transferring step includes the step of contacting an entire convex surface of the trip release member to a concave surface of the hammer.

* * * * *